United States Patent [19]

Gärtner

[11] Patent Number: 4,943,900

[45] Date of Patent: Jul. 24, 1990

[54] LIGHTING FIXTURE

[76] Inventor: Klaus Gärtner, Karl-Marx-Str. 80, D-1000 Berlin 44, Fed. Rep. of Germany

[21] Appl. No.: 229,949

[22] Filed: Aug. 9, 1988

[30] Foreign Application Priority Data

Aug. 10, 1987 [DE] Fed. Rep. of Germany ..... 8711021

[51] Int. Cl.[5] ..... F21S 3/00

[52] U.S. Cl. ..... 362/227; 362/232; 362/249

[58] Field of Search ..... 362/227, 249, 226, 240, 362/806, 217, 232, 319

[56] References Cited

U.S. PATENT DOCUMENTS

| | | | |
|---|---|---|---|
| 2,233,280 | 2/1941 | Barnes | 362/319 |
| 3,755,663 | 8/1973 | George, Jr. | 362/249 |
| 4,376,966 | 3/1983 | Tieszen | 362/223 X |
| 4,521,839 | 6/1985 | Cook et al. | 362/227 X |
| 4,581,687 | 4/1986 | Nakanishi | 362/226 |
| 4,597,035 | 6/1986 | Lettenmeyer | 362/219 |
| 4,607,317 | 8/1986 | Lin | 362/806 X |
| 4,739,454 | 4/1988 | Federgreen | 362/217 |

FOREIGN PATENT DOCUMENTS

| | | |
|---|---|---|
| 0043072 | 1/1982 | European Pat. Off. . |
| 0169165 | 1/1986 | European Pat. Off. . |
| 1189273 | 4/1970 | United Kingdom . |

*Primary Examiner*—Ira S. Lazarus
*Assistant Examiner*—Sue Hagarman
*Attorney, Agent, or Firm*—Spencer & Frank

[57] ABSTRACT

Lighting fixture including a light-transmitting lighting tube in which a plurality of series-connected miniature light bulbs are disposed and whose ends are provided with current connections in the form of female connectors which have an interior, centrally located, electrically conductive plug-in contact, so as to contact, when the lighting fixture is mounted, male connectors disposed in a holding head and connected with an electrical lead, the fixture further including a profiled connecting member which has a cross section in the shape of a circle segment and which, in the mounted state of the lighting fixture, is arranged so as to be rotatable about the lighting tube. The holding heads (*2a, 2b*) can be inserted into the ends of the profiled connecting member (3) and can be connected in a form-locking manner with the profiled connecting member (3) by rotating the profiled connecting member (3) and/or the holding heads (*2a, 2b*).

10 Claims, 5 Drawing Sheets

LIGHTING FIXTURE

BACKGROUND OF THE INVENTION

The invention relates to a small attractive lighting fixture and especially a lighting fixture which is shaded and allows the angular direction of the light.

The lighting fixture of EP-0,169,165-A1 includes a light-transmitting lighting tube in which a plurality of miniature light bulbs are connected in series and arranged in separate chambers in a plastic strip. At the ends of the light-transmitting lighting tube, female connectors are provided which serve as current terminals and include an electrically conductive plug-in contact disposed centrally within a plastic sleeve which projects beyond the plug-in contact. In the mounted state of the lighting fixture, the plug-in contacts establish electrical contact with female connectors each associated with a holding head and connected with an electrical lead. For reasons of protection, the female connectors are sunk inside the holding heads.

The holding heads are rotatably connected with tubular arms to permit the lighting fixture to be fastened on a wall by means of retaining clips or in any other desired manner.

The mount for the lighting fixture is formed by the two holding heads and a profiled connecting member which connects the holding heads with one another and surrounds the lighting tube in the form of an extruded profiled member of aluminum or metallized plastic having a cross section in the shape of a segment of a circle. At its end regions and in its center region, the profiled connecting member is provided with webs which enclose recesses for the clamping accommodation of screws or pins. However, because of its firm connection with the holding heads, the profiled connecting member of the known lighting fixture cannot be rotated so that the light generated by the miniature light bulbs and emanating from the circle segment opening of the profiled connecting member is radiated out from the lighting fixture in only one given direction.

EP-0,043,072-Al discloses a lighting fixture having light sources in the form of a plurality of series-connected double-ended tubular lamps in which the lighting tube is inserted into holding elements disposed at the end of elastically bendable fastening arms. Although, in this prior art lighting fixture, the lighting tube is rotatable about its axis, no protection is ensured against bare electrical leads in the holding heads when the lighting tube is removed by bending apart the tubular arms.

SUMMARY OF THE INVENTION

It is an object of the invention to provide a lighting fixture of the above-mentioned type which ensures axial rotation of the profiled connecting member for setting the light radiation angle of the lighting fixture which, is very stable when assembled and in which the voltage-carrying parts are protected from physical contact and which is easily attached and detached.

The above is accomplished in accordance with the present invention, by providing for axial rotation of the profiled connecting member, making it possible to set the radiation angle of the light fixture in the desired direction, while simultaneously ensuring under all circumstances that the voltage carrying components in the holding heads and at the outer ends of the lighting tube are protected from physical contact. The arrangement of the profiled connecting member between the holding heads, ensures great stability for the lighting fixture when assembled, while the type of connection between the profiled connecting member and the holding heads ensures easy assembly and disassembly of the individual parts of the lighting fixture.

The invention is based on the realization that rotation of profiled connecting members and holding heads relative to one another can produce a fastened state in which, in given relative positions of mutual rotation, holding elements engage behind corresponding elements at the other component and according resist pulling forces in the axial direction.

An advantageous feature of the solution according to the invention is characterized in that the connection of the holding heads with the ends of the profiled connecting member is effected in the manner of a bayonet lock, with, as a particular advantage, the part of the holding heads which is to be inserted into the profiled connecting member having a cylindrical surface and two oppositely disposed flattened portions as well as two annular webs to connect the flattened portions. In the assembled state of the lighting fixture, these annular webs engage in corresponding annular grooves disposed in the interior at the ends of the profiled connecting member. This form of connection between profiled connecting member and holding heads is very stable since, on the one hand, it is a form-locking connection and, on the other hand, the part of the holding heads which can be inserted into the profiled connecting member lies against the inner face of the profiled connecting member over a greater length. At the same time, it is possible to make a connection between the holding heads and the profiled connecting member which permits the lighting fixture to be given a compact and slender configuration. In spite of the profiled connecting member being rotatable, the voltage carrying components of the holding heads and of the ends of the lighting tube are sunk and thus protected from physical contact. In this embodiment of a "bayonet" coupling, the profiled connecting member is initially inserted in the transverse direction before an additional rotation moves it into a position in which securing in the axial direction is effected by the elements mutually engaging behind one another.

According to a further feature the holding heads are not inserted into the connecting tube from the side of the opening but rather from its frontal faces.

It is then particularly favorable for the profiled connecting member to be configured as an extruded profile with the remaining parts of the annular web being continued past a recess to engage behind the web in the form of longitudinal webs which extend over the length of the profiled connecting member since this results in particular ease of manufacture.

The lighting fixture according t the invention is preferably suitable for the manufacture of small, elegant picture lights, emergency desk lights, piano lights, step lighting, display cabinet lighting, shelf lights, wardrobe lights, niche lights and smaller lighting strips.

BRIEF DESCRIPTION OF THE DRAWINGS

The idea on which the invention is based will now be described in greater detail with reference to the drawing figures, wherein.

DESCRIPTION OF THE PREFERRED EMBODIMENTS

Figure 1:
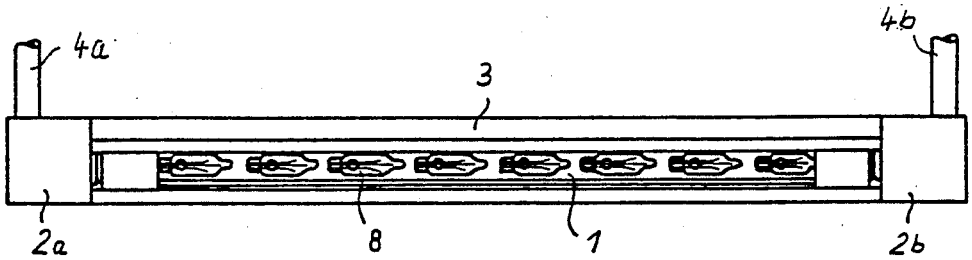
FIG. 1 is a side elevational view of a lighting fixture according to the invention including a lighting tube and a mount composed of two holding heads and a profiled connecting member.

The lighting fixture shown in FIG. 1 includes a lighting tube 1 in which a plurality of miniature light bulbs 8 are connected in series in a glass tube. The structural configuration of the lighting tube preferably corresponds to that described and illustrated in EP-0,159,165-A1. The ends of lighting tube 1 are inserted into holding heads 2*a* and 2*b* which are connected to one another by way of a profiled connecting member 3. Tubular arms 4*a* and 4*b* of any desired shape are inserted into holding heads 2*a* and 2*b* and can be fastened to a wall or an object by way of clips or the like. Cables are drawn through the tubular arms to the holding heads and are electrically connected to the plug-in contacts in the holding heads.

The profiled connecting member 3 arranged around lighting tube 1 has a arc-shaped cross section and is connected with holding heads 2*a*, 2*b* in an axially rotatable manner, thus permitting adjustment of the angle of the light emanating through the open are cutout.

Figure 2:
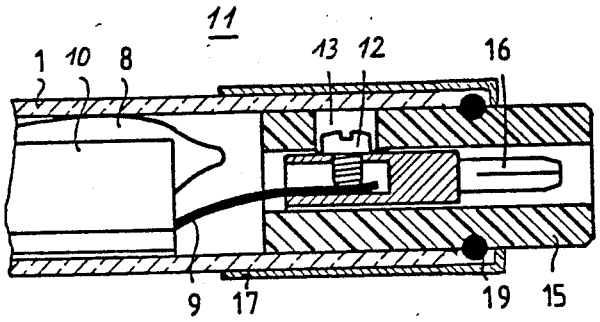
FIG. 2 is a sectional side elevational view through one end of the lighting tube of FIG. 1.

Since it must be easy to change the lighting tube central, insulated plug-in connectors 11, disposed at both ends of the tube which simultaneously serve to hold the lighting tube in a socket. The details of one of the two plug-in connectors are shown in FIG. 2.

Each plug-in connector includes a plastic sleeve 15 pushed into the end of lighting tube 1 and equipped with a central, electrically conductive male connector 16. The sleeve forms a rotary plastic member into which the central male connector 16 is inserted. The lighting tube 1 is protected by a projecting protective sleeve 17, preferably of aluminum which, is pushed over both its ends.

The end of the wire 9 which supplies the various seriesconnected miniature light bulbs 8 is fastened to male connector 16 by means of a clamping screw 12 which engages in a corresponding recess 13 of plastic sleeve 15 and secures the arrangement against displacement. Additionally, plastic sleeve 15 is provided with an 0-ring or the like 19 which, when inserted into the holder, secures the sleeve against inadvertent sliding out. To ensure that the arrangement is free of forces acting in the longitudinal direction which would move miniature light bulbs 8 out of the lighting tube, a profiled plastic member 10 is inserted into the lighting tube and is stably supported in the interior of lighting tube 1. This profiled plastic member 10 simultaneously stabilizes the arrangement of the miniature light bulbs 8 and protects them against shocks.

Figure 3:
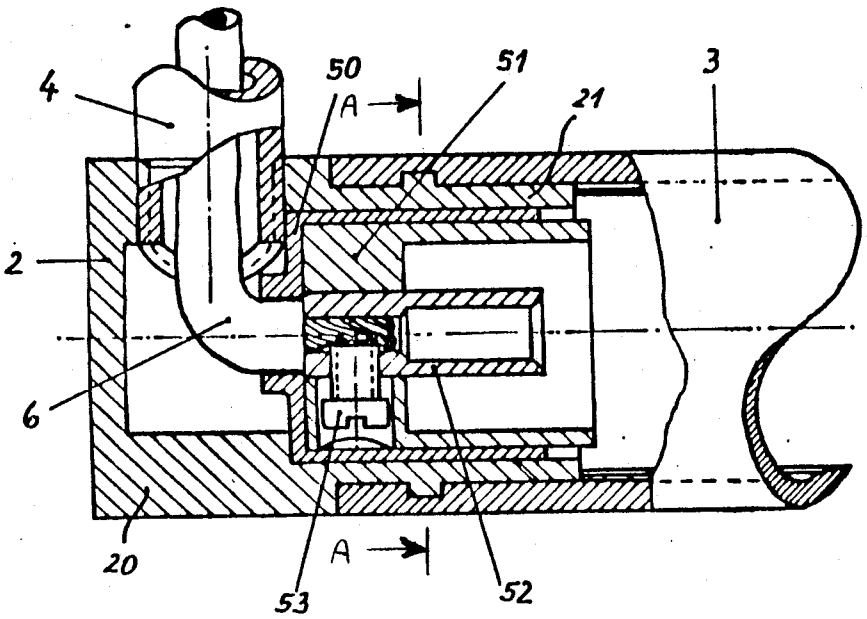
FIG. 3 is a sectional view of a holding head and the end of the profiled connecting member, partially in section.
Figure 5:
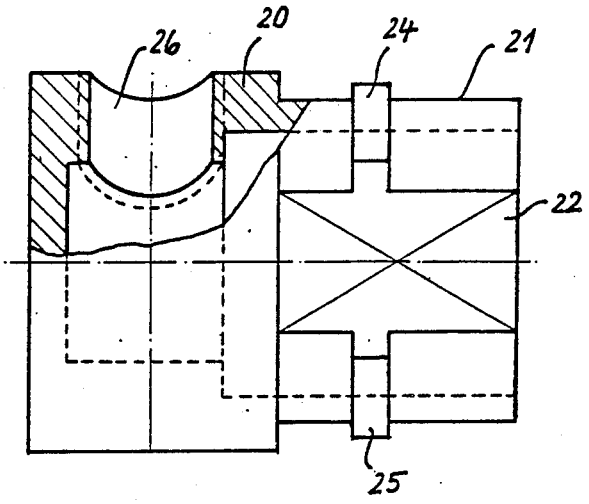
FIG. 5 is a partially sectional view of the holding head housing.
Figure 6:
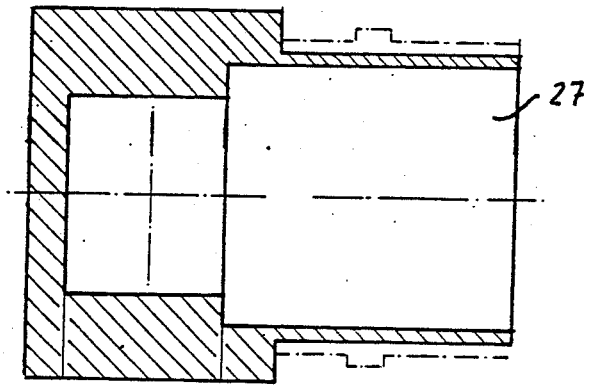
FIG. 6 is a sectional view of the holding head housing of FIG. 5.

FIG. 3 is an enlarged cross-sectional view of one of the two holding heads 2*a* and 2*b*, respectively, with the fitting sleeve disposed therein and one end of profiled connecting member 3. Enlarged details of the holding head shown in FIG. 3 can be seen in FIGS. 5 and 6.

The holding head is composed of a cylindrical end piece 20 followed by a member 24 which can be inserted into profiled connecting member 3. Cylindrical end piece 20 as well as the member to be inserted into profiled connecting member 3 are preferably made of aluminum or a metallized plastic and the cylindrical region of end piece 20 is provided with a radial bore 26 into which a tubular arm 4 is pushed. An axial bore 27 serves to accommodate an insulated socket 50 in which a plastic socket mount 51 is disposed. Socket mount 51 serves to accommodate a female connector 52 which contacts the male connector 16 of lighting tube 1 shown in FIG. 2 and which is connected by means of a screw 53 to a guide cable 6 drawn through tubular arm 4.

Figure 4:
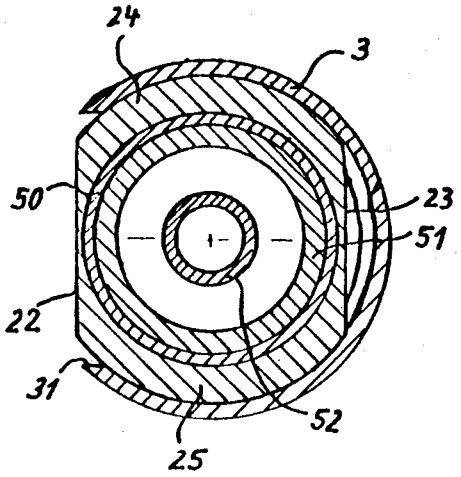
FIG. 4 is a cross-sectional view along line A—A of the illustration of FIG. 3.

As can be seen particularly in the illustration of FIG. 4, which is a cross-sectional view along line A—A of the illustration of FIG. 3, the member 21 of holding head 2 to be inserted into profiled connecting member 3 is provided with two oppositely disposed flattened portions 22 and 23 which are connected with one another by way of two annular webs 24 and 25. The length and arrangement of the annular webs on the outer face of member 21 to be inserted into profiled connecting member 3 are adapted to an annular groove 32 provided in profiled connecting member 3 in such a manner that, in the assembled state, a firm connection is ensured between profiled connecting member 3 and the respective holding head, with the frontal end of profiled connecting member 3 firmly lying against the shoulder formed by the cylindrical end piece 20 of holding head 2.

Figure 7:
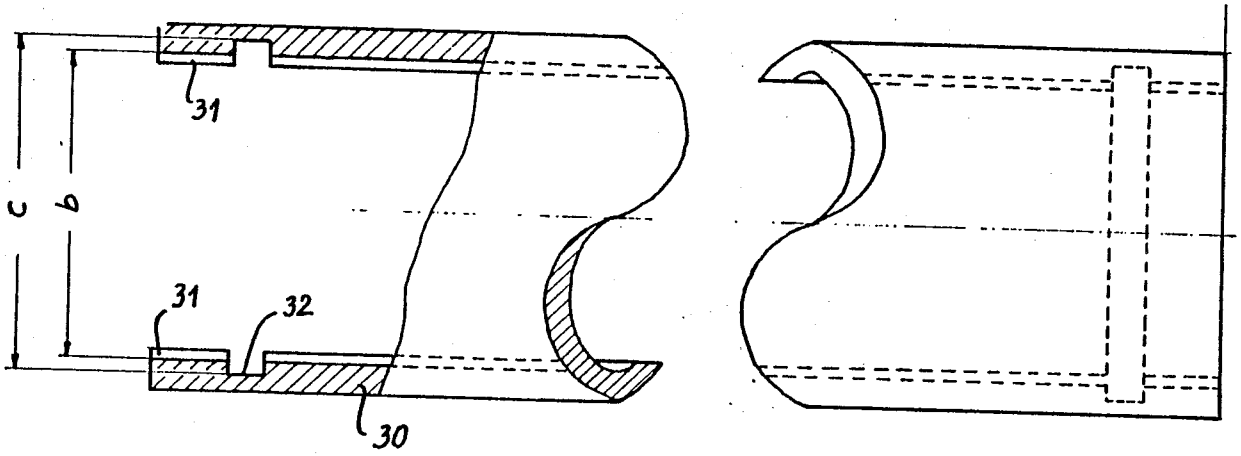
FIG. 7 is a partially sectional view of the ends of the profiled connecting member.

FIG. 7 is a partial sectional side view of profiled connecting member 3 and shows clearly the association of the connecting members between profiled connecting member 3 and holding heads 2*a* and 2*b*. Seen in cross section, profiled connecting member 3 forms an arc of about 210°, with the outer diameter of profiled connecting member 30 preferably being equal to the outer diameter of cylindrical end piece 20 of holding element 2 so that a smooth transition is ensured from cylindrical end piece 20 of holding element 2 to profiled connecting member 3. The longitudinal edges of the circle segment are provided with a chamfer 31 which lies at least in part against the flattened portions 22 and 23 of holding heads 2 when the latter are inserted. In this case, the distance between the flattened portions 22 and 23 of holding heads 2 of FIG. 4 is preferably equal to or slightly less than the distance b between the almost parallel chamfers 31 of profiled connecting member 3.

The inner diameter of annular groove 32 is preferably equal to the outer diameter of annular webs 24 and 25 at part 21 of holding heads 3 which are to be inserted into profiled connecting member 3.

The assembly and disassembly of the individual parts of the lighting fixture according to the invention will be described in greater detail with reference to the illustrations in FIGS. 3 and 4.

By rotating profiled connecting member 3 or holding heads 2 about 90°, annular webs 24 and 25 are brought out of engagement with annular groove 32 of profiled connecting member 3 and holding heads 2 can be pulled out of profiled connecting member 3 by pulling in the axial direction since in this position the flattened faces of holding heads 2 lie between chamfers 31 of the profiled connecting body 30 of profiled connecting member 3 and thus permit pulling apart.

When pulling holding heads 2 out of profiled connecting member 3, the electrical plug-in connection between female connector 52 and male connector 16 is separated.

Assembly takes place in the reverse of the above sequence the flattened faces of holding elements 2 are inserted between chamfers 31 of profiled connecting body 30 of profiled connecting member 3 and holding elements 2 are moved axially toward one another until the frontal face of profiled connecting member 3 abuts the shoulder formed by the cylindrical end piece 20 of holding elements 2. By rotating the profiled connecting member 3 or the holding head(s) about 90°, annular webs 24 and 25 engage in annular groove 32 of profiled connecting member 3 and establish a form-locking connection between profiled connecting member 3 and holding head 2 secure from being axially pulled apart. Also, profiled connecting member 3 can be rotated about the members 21 of holding heads 2 inserted into profiled connecting member 3 so that the direction of the light can be varied.

The length of the lighting fixture according to the invention as well as the number of miniature light bulbs arranged in the lighting tube and connected in series is almost arbitrary, with the firm connection of profiled connecting member 3 with holding heads 2 ensuring external stability for the lighting fixture with simultaneous adjustability of the direction of the light even in very long lighting fixtures.

Figure 8:
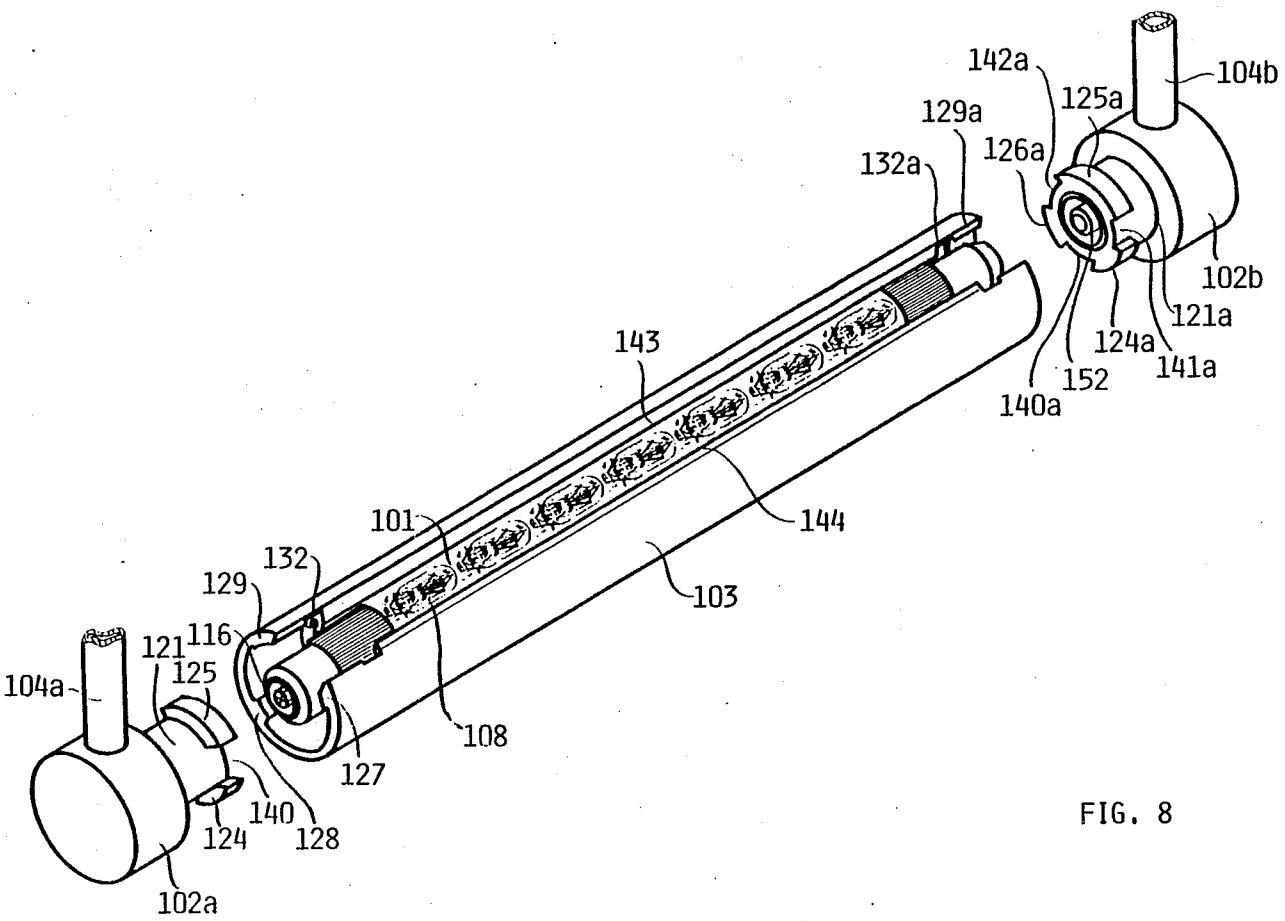
FIG. 8 is a second embodiment of the invention in a perspective view.

The embodiment shown in a perspective view in FIG. 8 is a lighting fixture design which basically corresponds to the illustration of FIG. 1. Components which are not described in greater detail here correspond to the components of the above-described embodiment bearing a reference numeral reduced by 100.

In contrast to the above-illustrated embodiment in which the bayonet coupling became effective in the transverse direction after the profiled connecting member had been pushed between the holding heads, assembly here takes place in the axial direction.

For this purpose, parts 121 and **121*a* of holding heads 102*a* and 102*b* which are to be inserted into profiled connecting member 103 are provided with a circumferential annular web 124, 125, 124*a*, 125*a*, 126*a* with regions 140, 140*a*, 141*a*, 142*a*** which interrupt the annular web.

The arrangement of these regions which interrupt the annular web here corresponds to the arrangement of members **127, 128, 129, 129*a* of an annular web provided at the ends of profiled connecting member 103 receiving holding heads 102*a*, 102*b*. Thus the arrangement of the remaining regions of annular web 124, 125, 124*a*, 125*a*, 126*a* at holding heads 102, 102*a* also corresponds to the arrangement of the regions which interrupt annular web 127, 128, 129 and 129*a* at the ends of profiled connecting member 103** so that, in the mounted state of the lighting fixture, the parts of the annular webs of the holding heads engage behind those of the profiled connecting member. In particular, the arrangement of the parts of the annular web and its interruptions is rotationally symmetrical in the circumferential direction.

Since the regions 140 of the holding heads which interrupt the annular web are smaller in the circumferential direction than the remaining regions of the holding head and the regions interrupting the annular web of the profiled connecting member ar larger in the circumferential direction than the regions remaining there, the remaining parts of the annular web of profiled connecting member 103, if the latter is produced as an extruded profile, can be continued over the length of the profiled connecting member following a correspondingly produced recess **132, 132*a*, to engage behind the annular web as webs 143 which likewise extend in the longitudinal direction to thus increase the rigidity of the profiled connecting member. Correspondingly, the opening region 144 of the profiled connecting member extends in a favorable manner between two remaining annular web regions 127 and 129**.

It can be seen that, in order to mount the lighting 5 fixture, it is merely necessary to introduce the holding heads in a suitable position into the profiled connecting member and arrest is then ensured by a simple rotation about any desired angle. Removal is possible only within three given, closely limited angular ranges. However, for this purpose a pull must be exerted on the holding heads in the axial direction which does not occur during normal use of the lighting fixture.

The invention is not limited in its embodiments to the above-described preferred embodiment. Rather, a number of variations are conceivable which take advantage of the described solution even for basically different configurations.

What is claimed is:

1. A lighting fixture comprising:

(a) two opposing holding heads;

(b) a female electrical connector disposed in the interior of each of the holding heads, the holding heads being positioned such that said female connectors face one another;

(c) a rigid lighting tube containing a plurality of series-connected miniature light bulbs, said lighting tube being disposed between said respective holding heads;

(d) a male electrical connector disposed on respective terminal ends of said lighting tube, each of said male connectors being electrically connected to one of said female connectors; and (e) a profiled connecting member having an arc-shaped cross-section and a gap, said profiled connecting member being disposed on each of said respective holding heads in a form-locking manner coaxially on the lighting tube, the profiled connecting member being rotatable about said lighting tube relative to said holding heads, whereby light only emits from the lighting fixture through the gap in the profiled connection member and the rotation of the profiled connection member controls the angle of illumination from the lighting fixture.

2. A lighting fixture according to claim 1, wherein the form-locking manner the profiled connecting member is disposed on each of the holding heads is a bayonet-like lock.

3. A lighting fixture according to claim 1, wherein each of the holding heads comprises a cylindrical surface having two facing, flattened portions and two annular webs connecting the flattened portions, and the profiled connecting member comprising cylindrical termal ends, each cylindrical end having an annular groove, the annular webs engaging, when the lighting fixture is in the mounted state, in corresponding annular grooves disposed in the ends of the profiled connecting member.

4. Lighting fixture according to claim 3 wherein the profiled connecting member includes a chamfer at least in the region of its ends disposed on the holding heads, said chamfers being oriented longitudinally at the outer edges of the gap in the arc-shaped cross-section.

5. Lighting fixture according to claim 4, wherein the distance between the flattened portions at the holding heads is slightly less or equal to the distance between the chamfers at the outer edges of the chord of the circle segment of the profiled connecting member.

6. A lighting fixture according to claim 1, wherein each of the holding heads comprise a first circumferential annular web and regions which interrupt the annular web and the profiled connecting member comprises a second circumferential annular web and regions which interrupt and second annular web, the arrangement of the regions interrupting the annular web of said profiled connecting member corresponding with the web of said holding heads, said first and second annular webs engaging one behind the other when said profiled connecting member is disposed on said holding heads.

7. A lighting fixture according to claim 6, wherein the arrangement of the parts of the annular webs and are rotationally symmetrical in the circumferential direction.

8. Lighting fixture according to claim 7, wherein the regions of the holding heads interrupting the first annular web are smaller in the circumferential dimension than the remaining regions of the holding head and the regions interrupting the second annular web of the profiled connecting member are larger in the circumferential dimension than the regions remaining of the profiled connecting member.

9. Lighting fixture according to claim 8, wherein the first annular web extends longitudinally and the second annular web of the profiled connecting member has a recess and extends longitudinally therefrom, with the parts of the second annular web being continued over the length of the profiled connecting member to permit the recess to engage behind the first longitudinally extending webs.

10. Lighting fixture according to claim 8, wherein the gap of the profiled connecting member extends between two remaining annular web regions.

* * * * *